US006382641B2

(12) United States Patent
Dennis et al.

(10) Patent No.: US 6,382,641 B2
(45) **Date of Patent: *May 7, 2002**

(54) SNOWBOARD BINDING SYSTEM WITH AUTOMATIC FORWARD LEAN SUPPORT

(75) Inventors: Brian D. Dennis; John D. Martin; Cameron W. Andrus, all of Vashon; Andy J. Aiken, Seattle, all of WA (US); Cory W. Smith, Sandy, UT (US)

(73) Assignee: K-2 Corporation, Vashon, WA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/081,837

(22) Filed: May 19, 1998

(51) Int. Cl.[7] ..... A63C 5/03

(52) U.S. Cl. ..... 280/14.22; 280/11.36; 280/617

(58) Field of Search ..... 280/14.2, 11.36, 280/14.22, 14.21, 611, 613, 617, 625; 36/117.1, 118.2, 118.4

(56) References Cited

U.S. PATENT DOCUMENTS

| | | | | |
|---|---|---|---|---|
| 4,653,203 | A | | 3/1987 | De Mattheis |
| 4,654,985 | A | | 4/1987 | Chalmers |
| 4,979,760 | A | | 12/1990 | Derrah |
| 5,031,341 | A | * | 7/1991 | Paris et al. ..... 36/121 |
| 5,143,396 | A | | 9/1992 | Shaanan et al. |
| 5,172,924 | A | | 12/1992 | Barci |
| 5,177,884 | A | | 1/1993 | Rullier |
| 5,259,127 | A | | 11/1993 | Pallatin |
| 5,261,689 | A | | 11/1993 | Carpenter et al. |
| 5,265,352 | A | | 11/1993 | Chemello |
| 5,356,159 | A | | 10/1994 | Butterfield |
| 5,356,170 | A | | 10/1994 | Carpenter et al. |
| 5,363,572 | A | * | 11/1994 | Marega et al. ..... 36/121 |
| 5,401,041 | A | | 3/1995 | Jespersen |
| 5,409,244 | A | | 4/1995 | Young |
| 5,435,080 | A | | 7/1995 | Meiselman |
| 5,505,477 | A | | 4/1996 | Turner et al. |
| 5,664,344 | A | * | 9/1997 | Marmonier ..... 36/118.2 |
| 5,727,797 | A | * | 3/1998 | Bowles ..... 280/14.2 |
| 5,778,566 | A | * | 7/1998 | Edauw et al. ..... 36/117.1 |
| 5,799,957 | A | * | 9/1998 | Okajima et al. ..... 280/14.2 |
| 5,855,390 | A | * | 1/1999 | Hassell ..... 280/607 |
| 5,901,971 | A | * | 5/1999 | Eaton ..... 280/14.2 |
| 5,975,557 | A | * | 11/1999 | Snoke et al. ..... 280/624 |

FOREIGN PATENT DOCUMENTS

| | | |
|---|---|---|
| EP | 0 596 281 A1 | 5/1994 |

* cited by examiner

*Primary Examiner*—Richard Chilcot
*Assistant Examiner*—James S. McClellan
(74) *Attorney, Agent, or Firm*—Christensen O'Connor Johnson Kindness PLLC

(57) ABSTRACT

A step-in binding system (20) for securing a boot (24) to a snowboard (22). The boot includes a sole defining a toe end, a heel end, and a binding attachment surfaces (46 and 50). The boot also has an elongate, substantially U-shaped highback (28) mounted to the exterior of the boot in the calf area thereof and extending from the ankle area to the top of the boot. The step-in binding system includes a toe and heel binding (62 and 64) attached to the snowboard for receiving and securing the boot to the snowboard. The step-in binding system also includes a lever arm (66) attached to the heel binding for selectively releasing the boot from the binding. A lean support member (68) is fastened near the rearward end of the binding for engagement with a stopper block (29) secured to the highback to define a minimum forward lean angle of the boot and to limit the aft flexure of the ankle support portion of the boot when the boot is received within the binding.

33 Claims, 7 Drawing Sheets

28
33
31
37
29
35
34
26
36
38
40
52
42
54
43
50
30
54
24
44
46
32
54
48
70
62
85
64
76
60
78
84
74
82
80
72
67
79b
85
84
66
20
68
79a
22

220
276
268b
229b
274
229a
268a 28
304
290
310
312
308
302
316
306
314
307
34
30
26
24
296
292
296
294
48
62
70
85
76
60
84
320
84
318
20
68
22

28
405
400
402
410a
410b
408b
408a
24
26
296
292
296
294
48
62
60
85
84
20
68
412a
404
412b
406

SNOWBOARD BINDING SYSTEM WITH AUTOMATIC FORWARD LEAN SUPPORT

FIELD OF THE INVENTION

The present invention relates generally to bindings for snowboards and, in particular, to a binding system with an automatic forward lean support.

BACKGROUND OF THE INVENTION

Snowboards have been in use for a number of years, and snowboarding has become a popular winter sports activity. The typical snowboard has an elongate flotation surface with an upwardly angled forward end and a tail end. A pair of bindings are rigidly attached between the edges of the snowboard, and are adapted to fasten the boots of a snowboarder to the snowboard. The edge of the snowboard closest to the toe end of the bindings is referred to as the toe edge, while the opposing edge is referred to as the heel edge. To maneuver a snowboard, it is desirable that snowboarders be able to bend their ankles, much in the same way surfers bend their ankles to maneuver a surfboard, thereby transferring their weight in the desired direction. A snowboarder may perform serpentine-like maneuvers by alternating his or her weight between the toe and heel edges of the snowboard. Thus, sufficient forward flexibility to permit an adjustable forward lean angle during use is desired. At the same time, it is desired that aft flexibility be limited so that the forward lean angle is maintained at no less than a minimum for proper heel edge control.

Step-in and strap bindings are the most common types of bindings currently available to couple a snowboarder's boot to the snowboard. A step-in binding includes a rigid plate that is attached to the snowboard and is adapted to receive toe and heel bails that are defined in the sole of the boot. Conventional, mountaineering-style boots used for snowboarding, like ski boots, include a molded plastic, stiff outer shell and a soft inner liner. Mountaineering-style boots are generally stiff enough to limit aft ankle flexibility and thereby provide the desired edge control and stability for maneuvering the snowboard. However, they are usually too stiff in the forward direction for some board maneuvers and for walking comfort when not bound to the snowboard. Mountaineering-type boots are also too stiff to allow significant lateral flexibility, a key movement in the sport and essential for freestyle enthusiasts. Furthermore, stiff mountaineering-type boots offer only marginal fore and aft flexibility, not only when the boot is attached to the binding, but also when the boot is removed from the binding and the snowboarder is walking. The stiff molded plastic outer shell does not permit sufficient fore and aft movement of the ankle for walking comfort and, therefore, is both an uncomfortable and difficult form of footwear for the snowboarder when the boot is not engaged with the binding of the snowboard. As a result, the mountaineering-type boots are generally too constraining for many snowboarders.

As noted above, freestyle snowboarding requires more lateral and forward flexibility of the ankle of the snowboarder than the mountaineering-type boots allow. Even all-around recreational snowboarding requires some boot flexibility. The stiff mountaineering-type boots offer little lateral flexibility and only marginal forward flexibility. Thus, because of the desire for flexibility, some snowboarders have opted for an insulated, flexible snowboot combined with a strap-on binding or a step-in binding, such as that disclosed in U.S. Pat. No. 5,505,477, issued to Turner et al. The flexible snowboot provides the flexibility desired by snowboarders for freestyle maneuvers, but may lack sufficient aft rigidity for proper edge control.

While flexibility is an aspect of snowboots that is desired by snowboarders for maneuvering the snowboard, too much aft flexibility is undesirable because the snowboot would lack the stiffness to properly transfer the snowboarder's weight between the toe and heel edges. The snowboarder's ability to initiate and properly execute a heel-edge turn requires that the snowboot have sufficient aft lean rigidity to maintain the forward lean angle at no less than a minimum. Aft lean limitation is important because it provides leverage on the snowboard during a heel-edge turn and it assists in angling the snowboard upwardly to further edge the heel edge into the snow during a heel-edge turn. Aft lean limitation of an otherwise flexible snowboot may be obtained by either inserting a highback plate between the liner and the outer shell of the boot, or mounting a highback on the exterior of the outer shell.

Prior attempts at increasing the forward lean stiffness of an otherwise relatively flexible snowboot have used a flexible snowboot having a pivoting highback. The snowboot is secured to the binding plate by a strap extending over the top of the forefoot portion of the snowboot. The strap extends from one side of the binding to the other. Although such a snowboot is comfortable to walk in when it is removed from the snowboard binding, it is not very convenient to attach the snowboot to the snowboard because of the strap binding. Such a system requires the snowboarder to manually adjust the strap around the snowboot before and after each run down a snow hill. Other attempts at increasing forward lean stiffness have used a stiff boot, such as the mountaineering-type boot described above, coupled to a snowboard by a step-in binding. Although such systems provide a simpler attachment of the boot to the snowboard, it fails to provide a boot that is comfortable to walk in when it is removed from the snowboard.

Thus, there exists a need for a snowboard boot binding that provides an automatic forward lean adjustment system while providing a highback that is allowed to flex rearwardly for walking comfort when the boot is removed from the binding. The present invention addresses these issues to overcome the limitations currently encountered by providing a forward lean device fastened to a step-in binding, thereby automatically limiting the minimum forward lean of the boot when the boot is engaged with the step-in binding.

SUMMARY OF THE INVENTION

The present invention is a step-in binding for securing a boot to a snowboard. The boot includes a toe end, a heel end, an ankle support portion capable of flexing relative to the plane of the sole, and an elongate, substantially U-shaped highback mounted to the exterior of the boot in the calf area thereof. The highback extends from the ankle area to the top of the boot. The step-in binding also includes an elongate rigid plate attached to the snowboard. The plate has a forward end and a rearward end. The step-in binding has at least a first binding member attached to the plate for receiving and coupling to a binding attachment surface defined by the sole region of the boot. A release member is attached to the first binding member for selectively releasing the boot from the first binding member. A forward lean support member is fastened substantially near the rearward end of the plate for engagement with the highback to define a minimum forward lean angle of the boot and to limit the aft flexure of the ankle support portion of the boot when the boot is received within the first binding member.

In the preferred embodiment, the lean support member is slidably adjustable between the forward and rearward ends of the plate, such that the lean support member may be adjusted therein to optimize the fit between the lean support member and the heel of the boot. Preferably, the lean support member is a U-shaped heel loop, the ends of which are fastened to first and second flanges that project upwardly from the plate.

In another aspect of the present invention, a Y-shaped stopper block depends downwardly from the highback and is positioned for engagement with the lean support member, such that the lean support member is receivable within a forked portion of the stopper block when the boot is coupled to the snowboard to define the minimum forward lean angle and to limit the aft flexure of the ankle support portion of the boot.

In an alternate embodiment, the step-in binding includes a Y-shaped stopper block fastened to the arcuate portion of the lean support member substantially between the ends thereof, such that the lower end of the highback is receivable within the forked portion of the stopper block to define the minimum forward lean angle and to limit the aft flexure of the ankle support portion of the boot.

In another alternate embodiment of the invention, the lean support member includes elongate first and second support arms. The first and second support arms are fastened to first and second flanges defined by the plate, respectively, such that they are substantially parallel to each other. The first and second support arms each include a stopper block projecting upwardly from each arm near the rearward end thereof. The stopper blocks of the alternate embodiment are positioned for engagement with the sides of the highback to define the minimum forward lean angle and to limit the aft flexure of the ankle support portion of the boot when the boot is coupled to the snowboard.

The step-in binding of the present invention provides several advantages over bindings currently available in the art. The step-in binding of the present invention provides an automatic forward lean adjustment system to limit the aft flexure of the ankle support portion of a snowboot, while providing a snowboot that is allowed to flex when the boot is removed from the binding. The step-in binding of the present invention also has the added advantage of permitting the snowboarder to selectively adjust the minimum amount of forward lean of the snowboot when the boot is mated to the snowboard. The step-in binding of the present invention is also simpler to use than those currently available in the art because the forward lean adjustment system is automatically engaged to the boot when the boot is coupled to the snowboard, thus eliminating the need of the snowboarder to manually attach and adjust the forward lean system when the snowboarder couples the snowboot to the snowboard. These advantages combine to define a step-in binding that has an automatic forward lean system, while providing a forward lean adjustment system that may be automatically disengaged for walking comfort.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
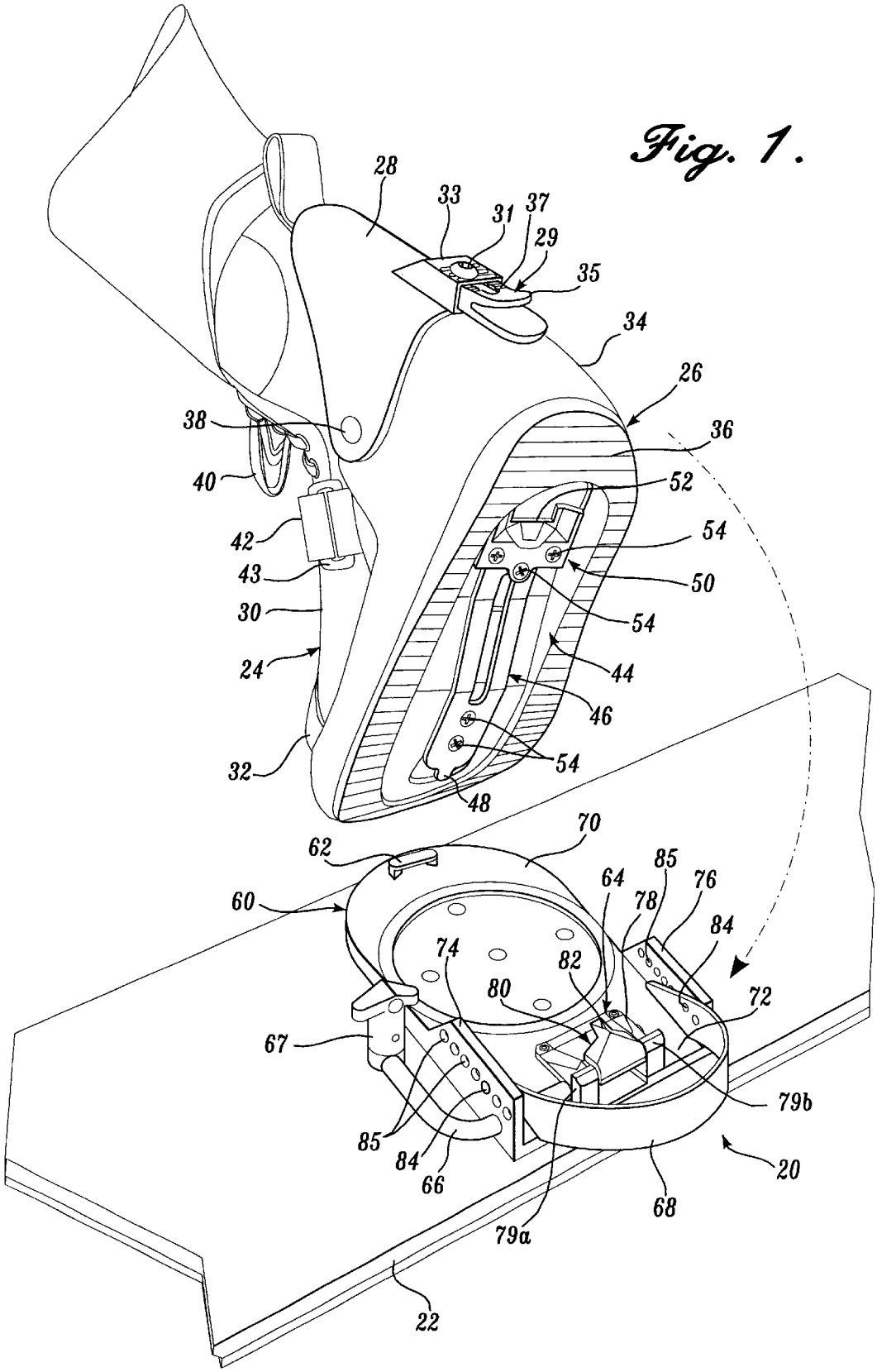
FIG. 1 is a perspective view of a step-in binding with an automatic forward lean adjustment system of the present invention attached to a snowboard and toe and heel attachment surfaces defined by the sole region of one of the boots.

FIG. 1 illustrates a preferred embodiment of a step-in binding system 20 constructed in accordance with the present invention. The step-in binding system 20 is shown attached to a snowboard 22 and is capable of receiving and securing a boot 24 to the snowboard 22.

The boot 24 includes a base 26, a highback 28, a stopper block 29, and an upper shoe portion 30. The base 26 is preferably constructed of a semi-rigid material that allows some flex and is resilient. The base 26, for example, may have a base construction similar to the sole construction of either hiking or mountaineering boots, including a last board on an elastomeric outer sole. The base 26 includes a toe cap 32, a heel counter 34, and a tread 36. The toe cap 32 is preferably an integrally formed portion of the base 26 and surrounds the toe or forward end of the upper shoe portion 30. Alternatively, the toe cap 32 may not be used or may be formed of a different material from the rest of the base 26, such as rubber. Because the upper shoe portion is preferably constructed from nylon or other flexible natural or manmade material, the function of the toe cap 32 is to protect the forward end of the upper shoe portion 30 from wear and water. The toe cap 32 also extends around the sides of the ball of the foot of the user. This arrangement adds additional lateral and torsional support to the foot of the user.

The heel counter 34 extends upwardly from the heel or rearward end of the base 26. The heel counter 34 surrounds and cups the heel portion of the upper shoe portion 30 and provides lateral support to the heel of the user. As with the toe cap 32, the heel counter 34 is preferably formed as an integral part of the base 26. Alternatively, however, the heel counter 34 could be constructed of a different material and attached to the base 26 by means well known in the art, such as glue.

The tread 36 extends downwardly from the base 26 and is preferably formed of a different material than the remainder of the base 26. The construction of the tread 36 is preferably an elastomeric material like that of conventional snowboots. The tread 36 may alternatively be constructed of a stiffer rubber, as commonly used on hiking boots. The toe end of the tread 36 angles upwardly toward the toe cap 32, so as not to interfere with the edging of the snowboard if the toe end of the boot 24 extends slightly over the edge of the snowboard 22. The heel end of the tread 36 also angles upwardly towards the heel counter 34.

The highback 28 extends upwardly from the heel counter 34, adjacent the rear and side portions of the upper shoe portion 30. The highback 28 is pivotally connected to opposing sides of the heel counter 34 by first and second highback pivot pins 38. Each pivot pin 38 is preferably a heavy-duty rivet, but alternately may be any other type of conventional pivoting fastener connection. The heel counter 34 includes an upward projection to allow the highback pivot pin 38 to be positioned to just beneath the ankle bone of the user for proper pivotal movement of the highback 28. The highback 28 is preferably formed of a resilient plastic material that is rigid enough to provide desired ankle support to the user. Thus, the highback 28 provides ankle support to the snowboarder and, because of the pivot pin 38, it is capable of flexing relative to the plane of the base 26 for increased walking comfort when the boot 24 is removed from the binding.

Still referring to FIG. 1, the stopper block 29 includes a rectangularly shaped housing 33 and a Y-shaped arm 35. The housing 33 has an open end and a cavity extending the length thereof. The housing 33 is attached centrally to the rearward outer side of the highback 28 by conventional fasteners, such as rivets, screws, or nuts and bolts. Alternatively, the housing 33 may be pivotally attached to the highback 28 by pinning one end of the housing 33 between rearwardly projecting sidewalls of a bracket (not shown), thereby permitting the housing 33 to swing away from the highback 28. In either method of attachment, the housing 33 is positioned on the highback 28 such that the open end thereof faces downward. The arm 35 is sized to be slidably received within the housing 33, with the forked portion thereof extending downwardly.

The arm 35 may be selectively extended or retracted within the housing 33 to permit the snowboarder to select the desired amount of minimum forward lean, to be described in greater detail below. The rearward facing surface 37 of the arm 35 is serrated such that it fits securely into complementary grooves (not shown) defined in the opposing internal surface (not shown) of the housing 33 when the arm 35 is received therein. The snowboarder may adjust the length of the arm 35 within the housing 33 by applying a slight pressure to the arm 35 until the serrated portion thereof is released from the grooved portion of the housing 33. The arm 35 then passes under the grooved portion until the desired extension of the arm 35 is achieved. The snowboarder then releases the pressure to the arm 35, causing the serrated portion to re-engage the grooved portion of the housing 33, thereby locking the arm 35 into the desired position. A conventional fastener 31, such as a spring-loaded stud and cam or a nut and bolt, is inserted though the elongate direction of the stopper block 29 to ensure that the extension of the arm 35 relative to the housing 33 remains fixed.

The upper shoe portion 30 is fixedly attached to the base 26 by being secured beneath the last board (not shown) of the base 26 by means well known in the art, such as glue or stitching. The toe cap 32 and heel counter 34 may also be glued to the upper shoe portion 30. The upper shoe portion 30 also includes a conventional vamp and vamp closure, including a lace 40 traversing the top of the foot from the toe area of the foot to the shin of the user. A securing strap 42 and buckles 43 are provided on the top of the upper shoe portion 30, for fastening the upper shoe portion 30 around the top of the foot. In the preferred embodiment, the upper shoe portion 30 is not attached to the highback 28, such that the flexibility of the upper shoe portion 30 is not limited by the highback 28. The highback 28 is adjacent and cups at least part of the rear and side portions of the upper shoe portion 30. Because the highback 28 is not attached to the boot 24 above the ankle portion, the upper shoe portion 30 is permitted to move both forwardly, laterally and medially.

Still referring to FIG. 1, the sole of the base 26 has a first cavity 44 formed generally between the ball and heel portions of the foot. An elongate toe attachment plate 46 is rigidly attached within the cavity 44 and includes a forward projecting tab 48 that is adapted to be received within the step-in binding system 20, to be described in greater detail below. A heel attachment plate 50 is also rigidly attached within the cavity 44 and includes a lock lip 52 that is spaced a predetermined distance from the base of the cavity 44. The lock lip 52 is adapted to be received within the step-in binding system 20, to be described in greater detail below. Both the toe and heel attachment plates 46 and 50 are rigidly attached within the cavity 44 by fasteners, such as screws 54 and are preferably constructed from a resilient, high-strength material, such as stainless steel.

FIG. 1 also illustrates one type of binding that may be used in conjunction with the step-in binding system 20 of the present invention. Additional bindings, such as those disclosed in U.S. Pat. No. 5,505,477 issued to Turner et al., hereby incorporated by reference, are also within the scope of the present invention. In the embodiment shown in FIG. 1, the binding includes a binding plate 60, a toe binding 62, a heel binding mechanism 64, a lever arm 66, and a heel loop 68. The binding plate 60 is secured to the snowboard 22 by conventional fasteners well known in the art, such as rivets or screws, extending vertically through the binding plate 60 and partially through the thickness of the snowboard 22. The binding plate 60 is mounted substantially normal to the elongate direction of the snowboard, such that the binding plate 60 extends between the edges of the snowboard 22.

The elongate binding plate 60 has a forward end 70 and a rearward end 72 and may be constructed from a high-strength material, such as stainless steel or aluminum. The binding plate 60 also has vertically projecting first and second side rails 74 and 76 extending upwardly from opposing sides of the binding plate 60. The side rails 74 and 76 extend from nearly midway between the forward and rearward ends 70 and 72 to the rearward end 72 of the binding plate 60. The toe binding 62 is configured as an inverted U and is rigidly attached near the forward end 70 of the binding plate 60 by a pair of screws (not shown) extending vertically through the arms of the toe binding 62 and partially through the thickness of the snowboard 22. The toe binding 62 is positioned to slidably receive the tab 48 of the toe attachment plate 46 between the arms of the toe binding 62, to be described in greater detail below.

The heel binding mechanism 64 includes a frame 78 and a movable jaw 80. The frame 78 has first and second L-shaped arms 79*a* and 79*b* that are rigidly fastened near the rearward end 72 of the binding plate 60, with the spine of the arms 79*a* and 79*b* flushly mounted to the binding plate 60 and base of the arms 79*a* and 79*b* projecting upwardly. The first and second arms 79*a* and 79*b* are spaced apart by a predetermined distance, such that the jaw 80 may be received therebetween. The jaw 80 is pivotally pinned between the arms 79*a* and 79*b* of the frame 78 by the lever arm 66 and the upper portion thereof includes a forward projecting tab 82. The lever arm 66 permits the user to selectively actuate the heel binding mechanism 64 between a closed position and an opened position. In the closed position, the tab 82 engages the lock lip 52 of the heel attachment plate 50 and is firmly seated on the lock lip 52, between the lock lip 52 and the base of the cavity 44. In the opened position, the lever arm 66 pivots the jaw 80, toward the rearward direction of the binding plate 60, and, thus, out of engagement with the lock lip 52, such that the heel of the boot 24 may be removed from the step-in binding system 20. The heel binding mechanism 64 is biased into the closed position by means well known in the art, such as a spring, and is constructed from a high-strength material, such as stainless steel or aluminum.

Still referring to the preferred embodiment of FIG. 1, the heel loop 68 is in the shape of a U, with the ends being releasably attached between the first and second side rails 74 and 76. The heel loop 68 is positioned for engagement with the stopper block 29, to be described in greater detail below. The ends of the heel loop 68 are fastened between the first and second side rails 74 and 76 by removable fasteners 84 well known in the art, such as cotter pins or screws. The fasteners 84 extend through holes (not shown) define through the thickness of the side rails 74 and 76 and are received within horizontally extending holes (not shown) in the ends of the heel loop 68.

Figure 2:
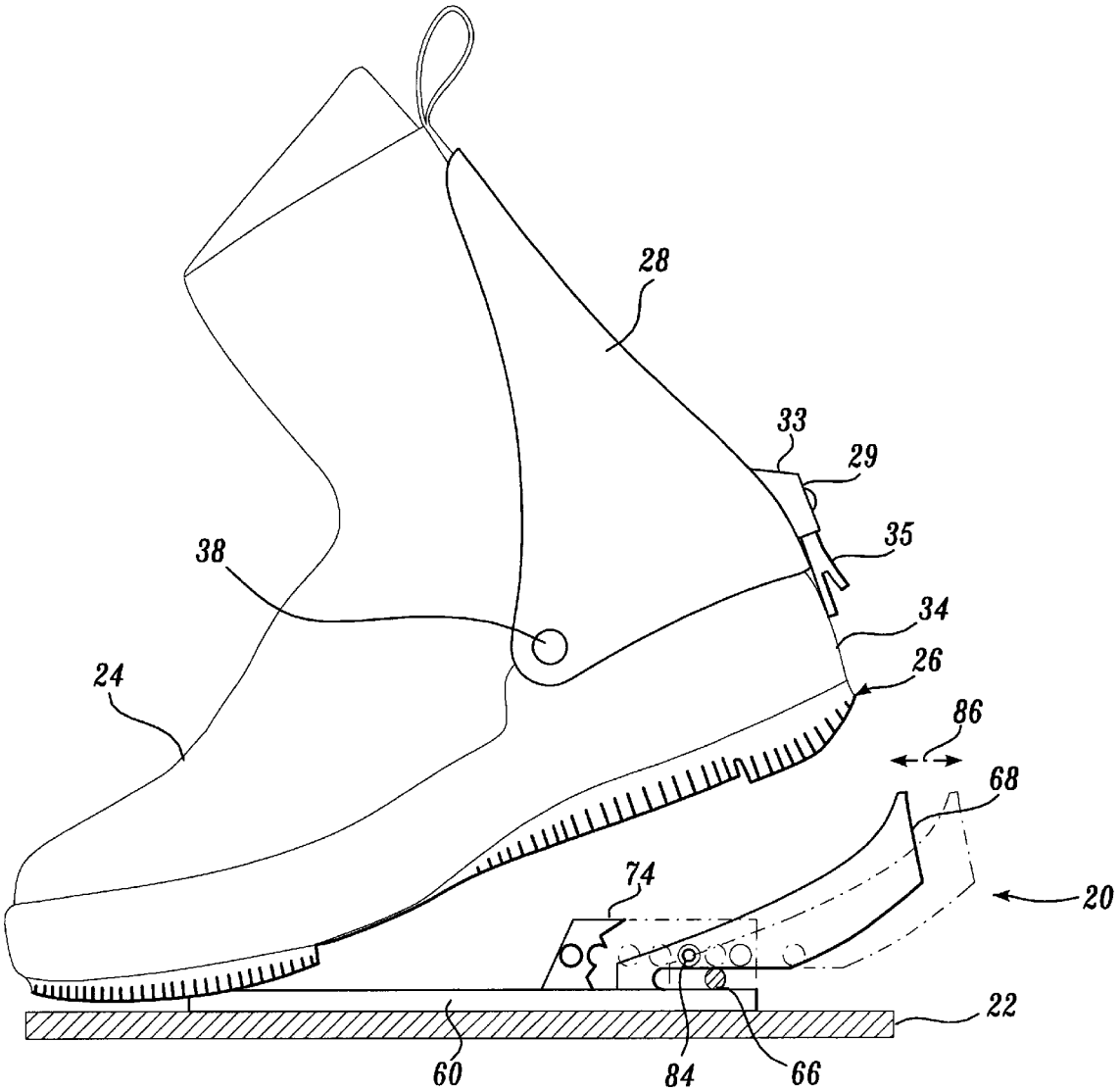
FIG. 2 is a side view of the step-in binding with an automatic forward lean adjustment system of the present invention with the toe attachment surface of the snowboot partially slid into the step-in binding and showing the adjustable aspect of the forward lean support.

As may be seen better in FIG. 2, the heel loop 68 is also adjustable in the elongate direction of the binding plate 60 by removing the fasteners 84 and sliding the heel loop 68 either forward or rearward, and as indicated by the arrow 86, relative to the first and second side rails 74 and 76. The side rails 74 and 76 include a plurality of adjustment holes 85 extending through the thickness thereof. The adjustment holes 85 allow the snowboarder to adjust the position of the heel loop 68 relative to the forward and rearward ends 70 and 72 of the binding plate 60, thereby optimizing the fit between the heel loop 68 and the heel end of the boot 24, as well as accommodating boots of different sizes. The fasteners 84 may then be reinserted, thereby locking the heel loop 68 into the desired location.

Operation of the present invention may be best understood by referring to FIGS. 1–3B. As seen in FIG. 2, the snowboarder has angled the toe section of the boot 24 downwardly, such that the tab 48 of the toe attachment plate 46 is slidably received within the open portion of the toe binding 62. After initial contact is made with the toe binding 62, the snowboarder applies a downward motion to the heel portion of the boot 24, such that the lock lip 52 of the heel attachment plate 50 engages the tab 82 of the heel binding mechanism 64. The downward pressure applied by the heel of the snowboarder overcomes the torque applied to the jaw 80 by the spring, thereby causing the jaw 80 to pivot rearwardly until the tab 82 slides into locking engagement with the lock lip 52 and into the position shown in FIG. 3A. When the boot 24 is bound to the step-in binding system 20, as shown in FIG. 3A, engagement of the stopper block 29 with the heel loop 68 serves to limit rearward pivotal motion of the highback 28 about a transverse axis generally aligned with the user's ankle and to set the highback 28 to a minimum forward lean angle. The upper edge of the center portion of the heel loop 68 is received between the forked portions of the lower end of the arm 35 of the stopper block 29. The center of the heel loop 68 thus bears against the stopper block 29, forcing the highback 28 to pivot forwardly to the selected minimum forward lean angle, of less than 90° relative to the base, as shown in FIG. 3A. During snowboarding maneuvers, rearward pivoting of the highback 28 from the position shown in FIG. 3A is prevented, thereby maintaining the minimum forward lean angle and providing good force transmission for heel edge control. However, further forward pivoting is permitted. In the preferred embodiment, the highback 28 is not attached to the upper shoe portion 30, such that when the upper boot portion 30 moves forward, the highback 28 may remain stationary and, therefore, the stopper block 29 remains engaged to the heel loop 68. In some alternate embodiments of the invention, the highback 28 may be secured to the upper shoe portion 30 (not shown), such that as the upper shoe portion 30 pivots, the highback 28 also pivots with the stopper block 29 pivoting forwardly out of engagement with the heel loop 68. The forked extensions on the lower end of the arm 35 of the stopper block 29 serve to guide the stopper block 29 into and out of proper alignment with the heel loop 68.

After boarding, the boot 24 may be released from the step-in binding system 20 by pulling up on the T-shaped handle 67 attached to the free end of the lever arm 66. As the lever arm 66 is rotated, it pivots the jaw 80 rearwardly and out of engagement with the heel attachment plate 50, thereby releasing the heel portion of the boot 24 from the binding.

In summary, when the boot 24 is received and fastened to the snowboard 22, the upper edge of the heel loop 68 is automatically received within the arcuate, or root, portion of the stopper block 29, thereby preventing rearward rotation of the upper shoe portion 30 of the boot 24 and defining the minimum forward lean angle of the boot 24 relative to the horizontal plane of the binding plate 60. The snowboarder can increase the forward lean angle of the boot 24 by transferring his or her body weight toward the vamp of the boot 24; however, the minimum forward lean angle is limited and defined by the interaction of the stopper block 29 and heel loop 68.

Figure 3B:
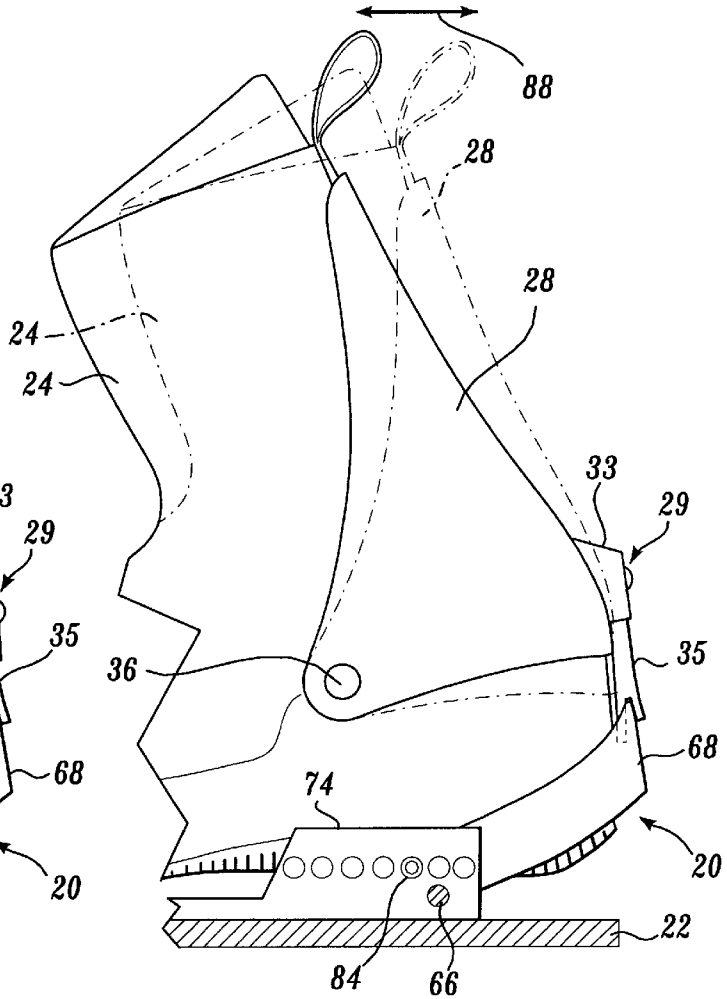
FIG. 3B is a side view of the step-in binding with an automatic forward lean adjustment system of the present invention with the snowboot fully engaged with the step-in binding of the snowboard and a boot having a greater forward lean.
Figure 3A:
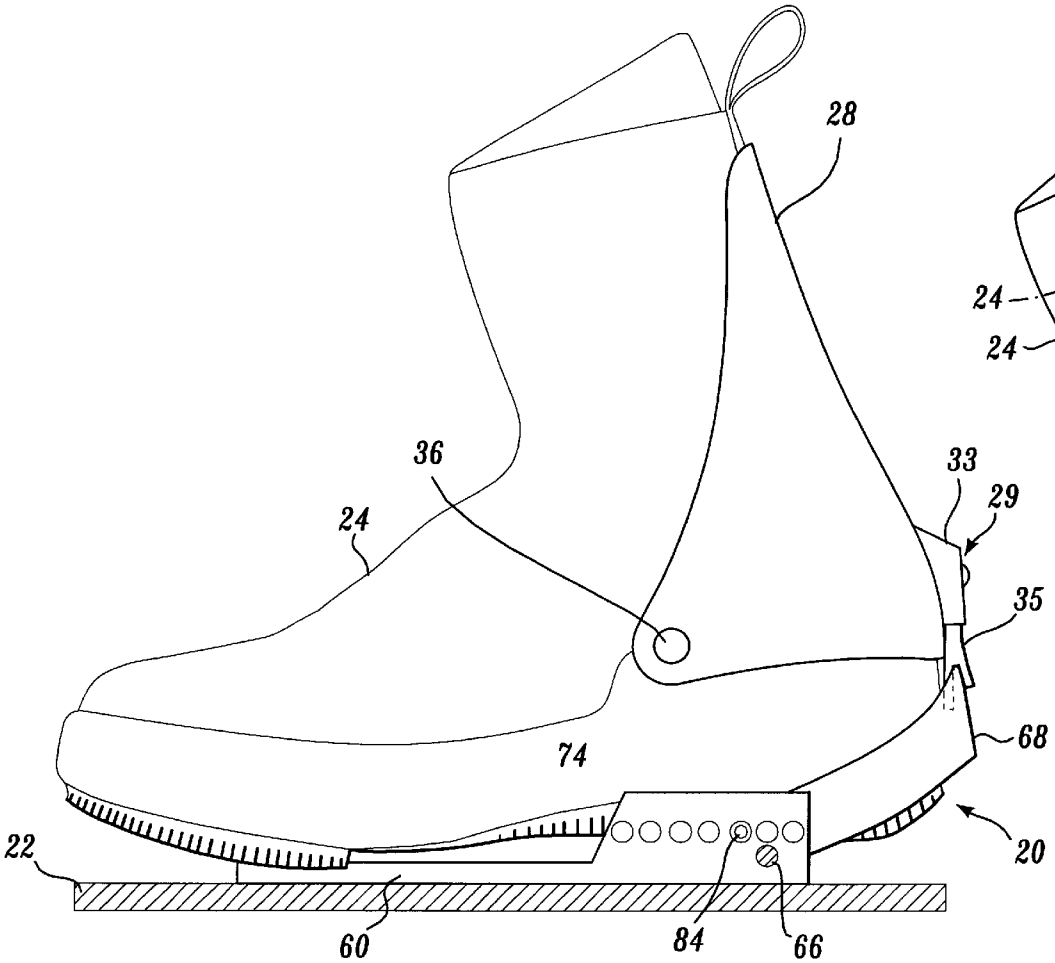
FIG. 3A is a side view of the step-in binding with an automatic forward lean adjustment system of the present invention with the snowboot fully engaged with the step-in binding of the snowboard and as it would be used by a snowboarder.

The automatic forward lean adjustment aspect of the present invention may be best understood by referring to FIG. 3B. The forward lean of the boot 24 may be selectively adjusted prior to use relative to the forward and rearward ends 70 and 72 of the binding plate 60, as indicated by the arrow 88. As described above, the snowboarder may adjust the length of the arm 35 within the housing 33 by applying a slight pressure to the arm 35 until the serrated portion thereof is released from the grooved portion of the housing 33 and then passing the arm 35 under the grooved portion until the desired extension of the arm 35 is achieved. The longer the arm 35 is extended relative to the housing 33, the more the aft flexibility of the boot 24 is limited and, therefore, the greater the minimum forward lean angle. Extending or retracting the length of stopper block 29 is desirable because it allows the snowboarder to redefine the forward lean angle of the boot 24 depending on the riding style preferred or on the type of snowboarding engaged in. For example, additional forward lean may be desirable for carving on hard-packed snow surfaces, whereas less forward lean may be desirable in deep powder or for certain freestyle maneuvers. Thus, not only may the rider selectively adjust the minimum forward lean angle of the boot 24, but it is also automatically engaged whenever the boot 24 is attached to the snowboard 22.

Figure 4:
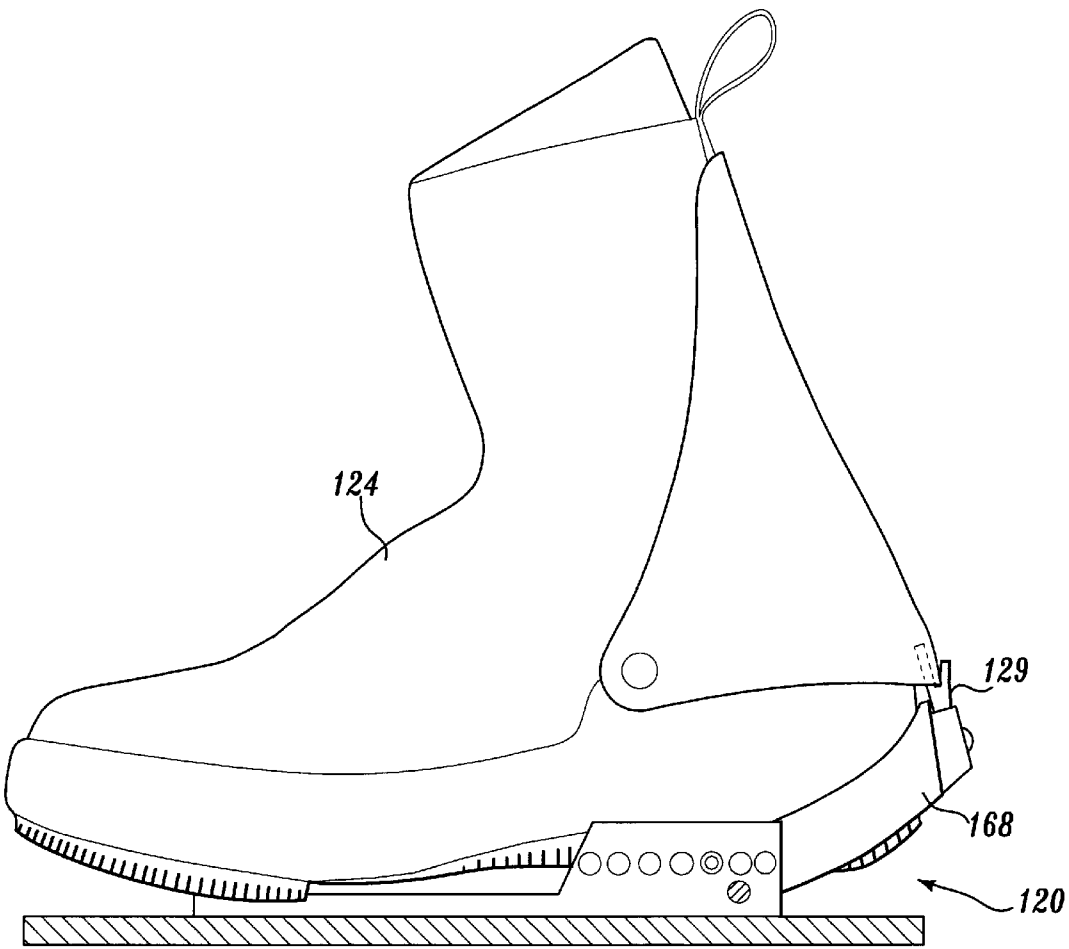
FIG. 4 is a side view of a second embodiment of the step-in binding with an automatic forward lean adjustment system, showing the stopper block attached to the heel loop of the binding and the forked portion of the stopper block shown partially in phantom and engaged with the highback of the snowboot.
Figure 5:
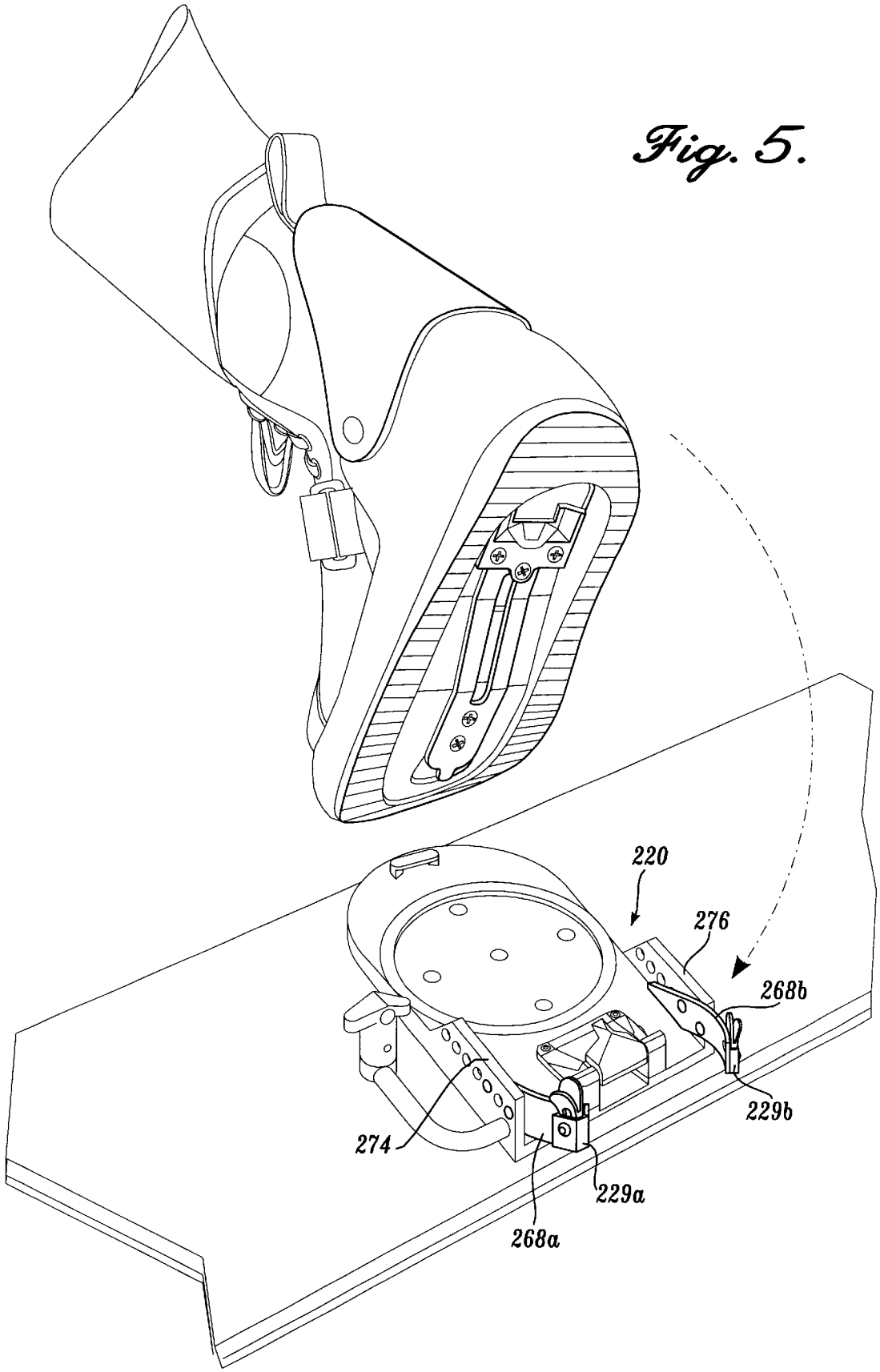
FIG. 5 is a perspective view of a third embodiment of the step-in binding with an automatic forward lean adjustment system of the present invention, having a two-piece heel loop and two stopper blocks attached to the heel loop and positioned to engage the highback of the snowboot.

Although slidably attaching the stopper block 29 to the backstay of the boot 24 is the preferred embodiment, as seen in FIGS. 4 and 5, alternate embodiments of the stopper block and heel loop are also within the scope of the present invention. As seen in FIG. 4, the stopper block 129 may be adjustably attached to the rearward portion of the heel loop 168. Except for the location of the stopper block 129, the step-in binding system 120 of FIG. 4 is identical in construction and use as described above for the preferred embodiment.

Referring to the third alternate embodiment of FIG. 5, the heel loop 68 may be configured as a two-piece element instead of a single-piece element. The heel loop 68 has first and second heel arms 268*a* and 268*b* that are slidably attached at a first end thereof to the first and second side rails 274 and 276 in a manner as described above for the preferred embodiment. First and second stopper blocks 229*a* and 229*b* are adjustably attached to the free ends of the heel arms 268*a* and 268*b* in a manner described above. The stopper blocks 229*a* and 229*b* and the heel arms 268*a* and 268*b*, as well as the step-in binding system 220, are identical in construction and use as described above for the preferred embodiment.

Figure 6:
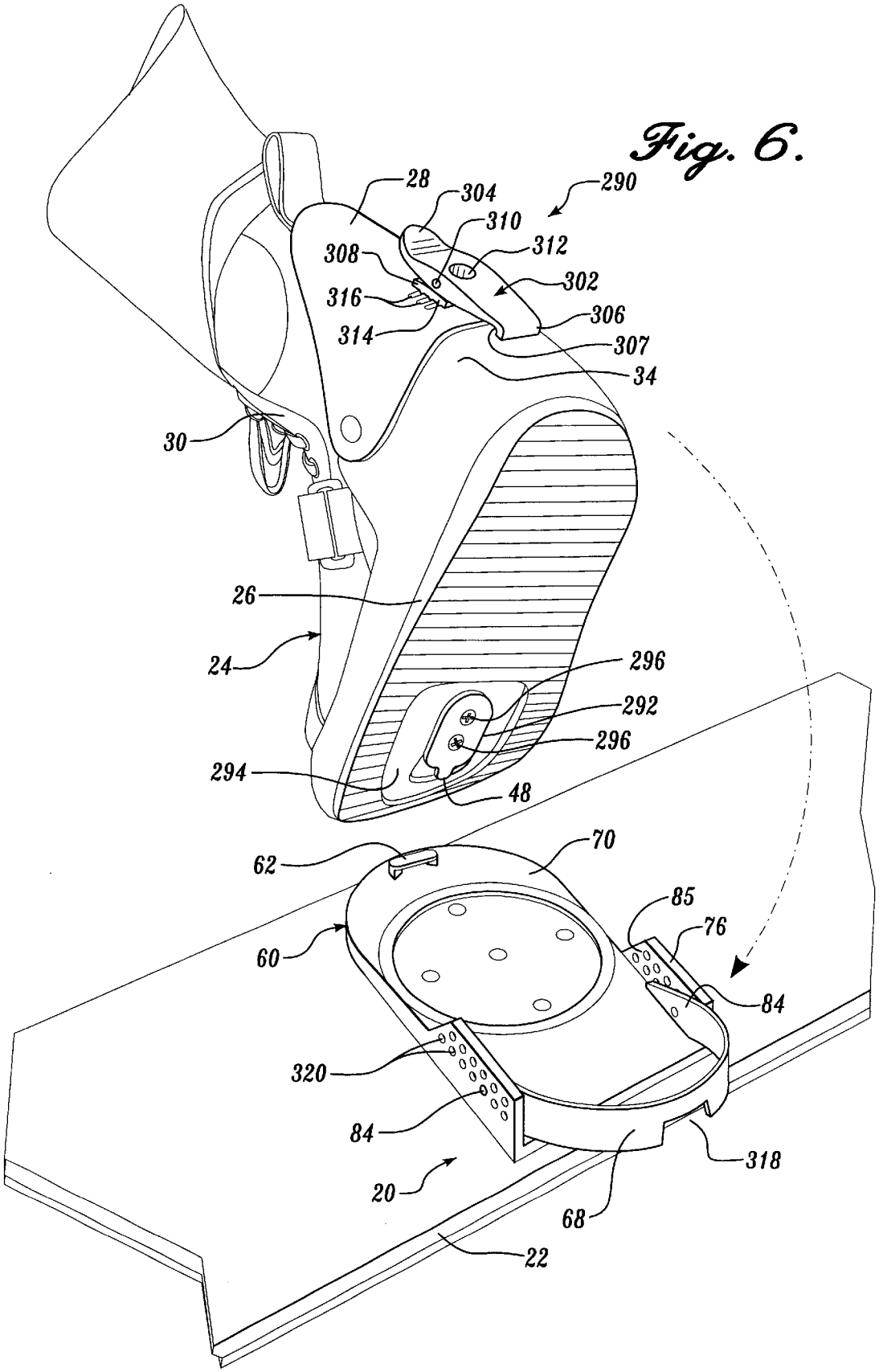
FIG. 6 is a perspective view of a fourth embodiment of the step-in binding with an automatic forward lean adjustment system of the present invention, having a single piece heel loop and a hinged stopper block attached to the highback of the snowboot.

Referring to the fourth alternate embodiment of FIG. 6, the boot 24 is configured and constructed as described above for the preferred embodiment, except that the heel attachment plate 50 (FIG. 1) has been replaced by a combination heel hold down-automatic forward lean adjustment assembly 290 ("heel attachment assembly 290"). The toe attachment plate 46 and heel attachment plate 50 of the preferred embodiment seen in FIG. 1, have been replaced by a toe plate 292 and the heel attachment assembly 290. The toe plate 292 is substantially shorter in length than the toe attachment plate 46 of the preferred embodiment. The toe plate 292 is fastened within a toe cavity 294, located in the ball area of the base 26, by first and second screws 296*a* and 296*b* extending vertically through the toe plate 292 and into the base 26.

The toe plate 292 of the alternate embodiment provides the snowboarder with increased walking comfort when the boot 24 is not engaged with the binding plate 60. As seen in FIG. 6, the toe plate 292 is limited to the ball area of the foot and, therefore, results in a more natural walking motion because the snowboarder is freely able to plantarflex his or her foot. The alternate embodiment of FIG. 6 is also simpler because it combines both the attachment of the heel portion of the boot together with the forward lean adjustment into a single pivotable arm. The toe end of the boot 24 is attached to the toe binding 62 of the binding plate 60 by the toe plate 292 in a manner described above for the first preferred embodiment, and the heel end of the boot 24 is attached to the binding plate 60 by the heel attachment assembly 290.

The heel attachment assembly 290 includes an attachment arm 302 having an upper end 304, a lower end 306, and a slider plate 308. The attachment arm 302 is hingedly attached to the slider plate 308 by a pivot pin 310 that extends laterally through the attachment arm 302 and through first and second flanges (not shown) extending outwardly from the slider plate 308. The attachment arm 302 and slider plate 308 are centrally located on the rearward facing side of the highback 28 by adjustable attachment means (not shown) well known in the art, such as a T-bolt and nut. Preferably, the highback 28 includes a vertically extending adjustment channel (not shown) centrally located in the rearward facing side thereof. The head of the T-bolt is positioned between the upper boot portion 30 and the highback 28, such that the threaded portion projects outwardly from the adjustment channel and into a centrally located cavity 312 defined substantially midway between the upper and lower ends 304 and 306 of the attachment arm 302 and extends vertically therethrough. The side of the adjustment plate 308 adjacent the highback 28 includes a plurality of interlocking ridges 314 extending laterally between the sides thereof. The ridges 314 are sized to fit into complementary lock grooves 316 defined in the highback 28 and are located normal to the adjustment channel, such that the snowboarder may selectively adjust the attachment arm 302 vertically along the rearward side of the highback 28. When the snowboarder achieves the desired position of the attachment arm 302, the ridges 314 are set within the grooves 316, and the attachment arm 302 is securedly held in the desired position by tightening the nut to the T-bolt extending through the central cavity 312.

The attachment arm 302 is preferably configured as an L-shaped member having a lower end 306 that is sized to fit into locking engagement with a complementary notch 318 centrally located in the lower surface of the heel loop 68. The lower end 306 terminates in an upwardly projecting tab 307 that extends the width of the lower end 306. Operationally, when the boot 24 is attached to the snowboard 22 by the toe plate 292, the heel area of the boot is pressed into the binding plate 60, such that the lower end 306 of the attachment arm 302 slides over the heel loop 68 and into the notch 308 until the tab 307 is locked between the heel counter 34 and the heel loop 68. Engagement of the attachment arm 307 secures the heel area of the boot 24 to the snowboard 22. To release the attachment arm 302 from the notch 308, the snowboarder would press the upper end 304 thereof towards the highback 28, causing the attachment arm 302 to pivot about the pivot pin 310, such that the lower end 306 moves out of locking engagement with the notch 318.

The forward lean of the highback 28 is limited by the engagement of the lower end of the highback 28 with the top of the heel loop 68. The amount of forward lean may be adjusted by vertically adjusting the heel loop 68 within the first and second side rails 74 and 76. As in FIG. 6, the side rails 74 and 76 include a plurality of adjustment holes 320 extending laterally therethrough. The adjustment holes 320 are defined in vertically spaced rows, such that the forward lean of the boot 24 may be adjusted by positioning the heel loop 68 into the desired row of attachment holes 320. The higher the heel loop 68 is placed within the side rails 74 and 76, the greater the amount of forward lean. Thus, the highback 28 of the boot 24 is forced into a predetermined amount of forward lean when the snowboarder steps into the binding plate 60, yet the boot 24 has increased forward and aft flexibility for increased walking comfort when the boot is not coupled to the snowboard 22.

Figure 7:
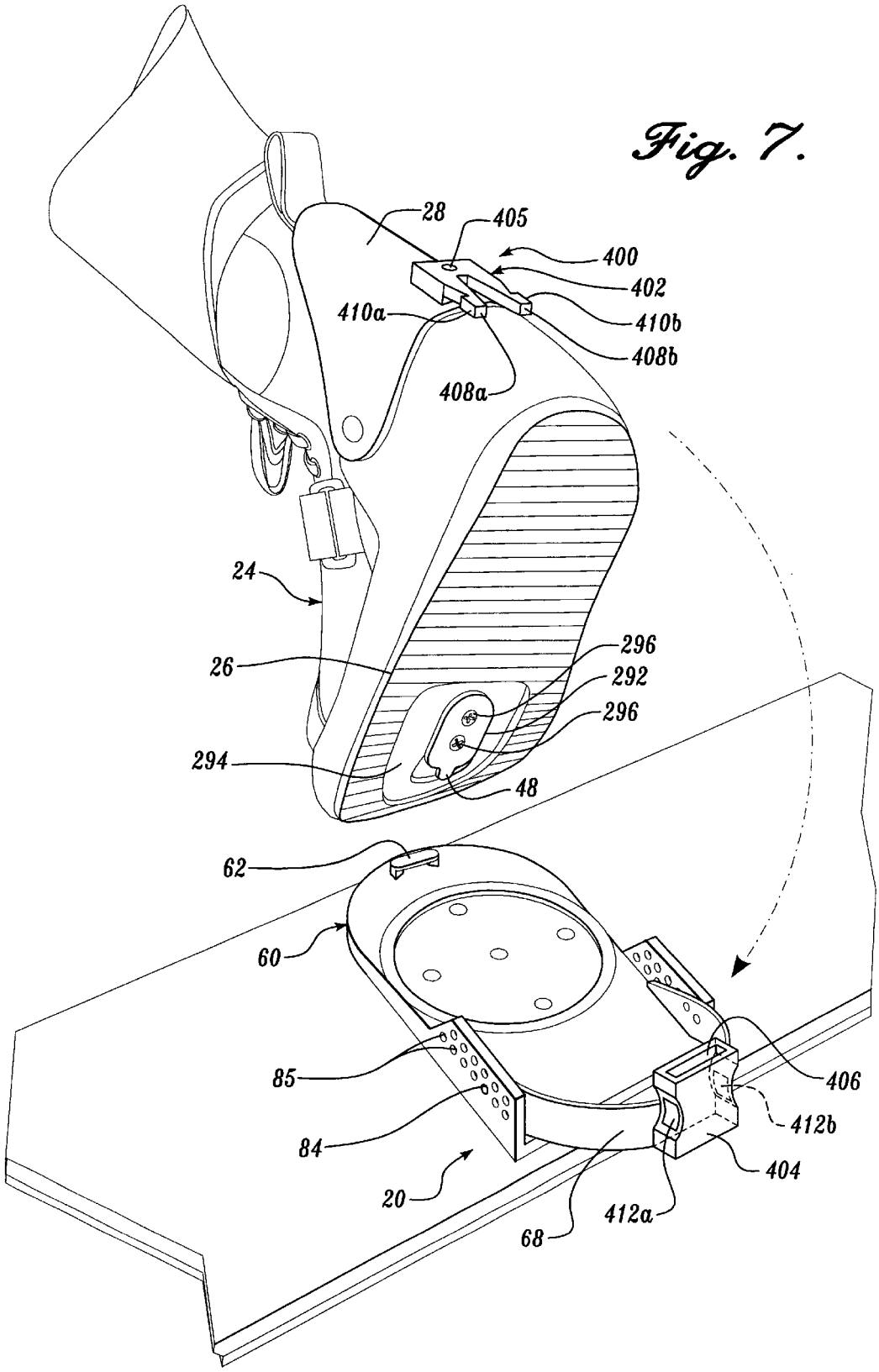
FIG. 7 is a perspective view of a fifth embodiment of the step-in binding with an automatic forward lean adjustment system of the present invention, having a buckle and receiver-type fastener to automatically limit the forward lean of the snowboot.

Referring to the fifth alternate embodiment of FIG. 7, the boot 24 is configured identically to that as described for the fourth alternate embodiment of FIG. 6, except that the heel attachment assembly 400 is configured as a buckle 402 and a receiver 404. The buckle 402 is preferably configured as an inverted V-shaped member and is preferably constructed from a resilient material, such as plastic. The buckle 402 is secured centrally to the rearward facing side of the highback 28 by a well known fasteners 405, such as screws or rivets. In some alternate embodiments of the invention, the buckle 402 may be adjustably fastened to the highback 28 by means well known in the art, such that the amount of forward lean may be adjusted by the snowboarder.

The receiver 404 is secured centrally to the rearward facing side of the heel loop 68 by well known fasteners extending through the heel loop 68 and into the side of the receiver 404 adjacent the heel loop 68. The receiver 404 is substantially rectangular in configuration and includes a channel 406 extending vertically therethrough. The channel 406 is sized to receive the arms 408*a* and 408*b* of the buckle 402 therein when the boot 24 is fastened to the binding plate 60, as described above. The arms 408*a* and 408*b* of the buckle 402 include first and second tabs 410*a* and 410*b* projecting outwardly from the ends thereof, such that the first tab 410*a* projects towards the lateral side of the boot 24, and the second tab 410*b* projects towards the medial side at boot 24. The first and second tabs 410*a* and 410*b* are sized to be received within first and second locking holes 412*a* and 412*b* defined in the sides of the receiver 404. As the heel portion of the boot 24 is received within the binding plate 60, the first and second arms 408*a* and 408*b* of the buckle 402 are slideably received within the channel 406 of the receiver 404 until the first and second tabs 410*a* and 410*b* are snapped into the first and second locking holes 412*a* and 412*b*. To release the heel assembly 400 from the binding plate 60, the snowboarder compresses the first and second tabs 410*a* and 410*b* of the buckle 402 towards each other until the tabs 410*a* and 410*b* have cleared the first and second locking holes 412*a* and 412*b*, thereby permitting the arms 408*a* and 408*b* to slide upwardly within the channel 406 as the heel portion of the boot is lifted from the binding plate 60. Thus, the boot 24 of the fifth alternate embodiment also has a predetermined amount of forward lean when the boot 24 engages the binding plate 60, and the boot 24 has increased forward and aft flexibility for increased walking comfort when the boot 24 is not coupled to the snowboard 22.

The previously described versions of the present invention provide several advantages over bindings currently available in the art for snowboards. The step-in binding of the present invention provides an automatic forward lean adjustment system to limit the aft flexure of the boot, while providing a boot that is allowed to flex rearwardly when it is removed from the binding for increased walking comfort. The step-in binding of the present invention also has the added advantage of permitting the snowboarder to selectively adjust the minimum amount of forward lean of the snowboot when the boot is mated to the snowboard. The step-in binding of the present invention is also simpler to use than those currently available in the art because the forward lean adjustment system is automatically engaged to the boot when the boot is coupled to the snowboard, thus eliminating the need of the snowboarder to manually attach and adjust the forward lean system when the snowboarder couples the snowboot to the snowboard. Thus, the present invention offers a step-in binding that has an automatic forward lean system, while providing a forward lean adjustment system that may be automatically disengaged for walking comfort.

From the foregoing description, it may be seen that the step-in binding system of the present invention incorporates many novel features and offers significant advantages over the prior art. It will be apparent to those of ordinary skill that the embodiments of the invention illustrated and described herein are exemplary only and, therefore, changes may be made to the foregoing embodiments while remaining within the spirit and scope of the present invention.

The embodiments of the invention in which an exclusive property or privilege is claimed are defined as follows:

1. A step-in binding for securing a boot to a bearing member capable of traversing a surface, the boot having a sole defining a toe end, a heel end, and a binding attachment surface, an ankle support portion capable of flexing relative to the plane of the sole, and an elongate ankle support member mounted to the exterior of the boot in the calf area thereof, the step-in binding comprising:

(a) at least a first binding member attached to the bearing member for receiving and coupling to the binding attachment surface of the boot, the first binding member having a forward end and a rearward end; and (b) a lean Support member fastened to the rearward end of the first binding member for engagement with the ankle support member of the boot to define a minimum forward lean angle of the ankle support portion of the boot and to limit the aft flexure of the ankle support portion of the boot when the boot is received within the first binding member and to permit the ankle support portion of the boot to flex beyond the minimum forward lean angle when the boot is not received within the first binding member.

2. The step-in binding of claim 1, further comprising a release member attached to the first binding member for selectively releasing the boot from the first binding member.

3. The step-in binding of claim 1, wherein the ankle support member is a highback mounted to the exterior of the boot in the calf area thereof and extends from below to above the ankle area of the boot.

4. The step-in binding of claim 3, wherein the bearing member is a snowboard.

5. The step-in binding of claim 4, wherein the lean support member is slidably adjustable between the forward and rearward ends of the first binding member, such that the lean support member may be adjusted therein to optimize the fit between the lean support member and the heel end of the boot.

6. The step-in binding of claim 5 further comprising an elongate plate securable to the snowboard, the plate having a forward end and a rearward end, the first binding member is attached to the plate, the plate has upwardly projecting first and second flanges formed on opposing sides of the plate substantially near the rearward end thereof.

7. The step-in binding of claim 6, wherein the lean support member is a U-shaped heel loop having an upper side and a lower side, and the ends of the heel loop are fastened to the upwardly projecting first and second flanges.

8. The step-in binding of claim 7, further comprising a Y-shaped stopper block, the stopper block having a forward facing surface and a rearward facing surface, the stopper block fastened to the arcuate portion of the first lean support member between the ends thereof, such that a lower end of the highback is receivable within the forked portion of the stopper block when the boot is secured to the first binding member to define the forward lean angle and substantially reduce the aft flexure of the ankle support portion of the boot.

9. The step-in binding of claim 8, wherein the stopper block comprises an adjustment member extending outwardly from the rearward facing surface to slidably adjust the stopper block along the longitudinal axis thereof, such that the degree of forward lean may be selectively optimized by the adjustment member.

10. The step-in binding of claim 7, further comprising a Y-shaped stopper block, the stopper block having a forward facing surface and a rearward facing surface, the stopper block depending downwardly from the highback and positioned for engagement with the lean support member, such that the lean support member is receivable within the forked portion of the stopper block when the boot is coupled to the snowboard to define the forward lean angle and substantially reduce the aft flexure of the ankle support portion of the boot.

11. The step-in binding of claim 10, wherein the stopper block comprises an adjustment member extending outwardly from the rearward facing surface to slidably adjust the stopper block along the longitudinal axis thereof, such that the degree of forward lean may be selectively optimized by the adjustment member.

12. The step-in binding of claim 6, wherein the lean support member further comprises elongate first and second support arms, the first and second support arms having a forward end and a rearward end, and the first and second support arms are fastened to the first and second flanges, respectively, such that they are substantially parallel to each other.

13. The step-in binding of claim 12, wherein the first and second support arms further comprise first and second stopper blocks projecting upwardly from each support arm substantially near the rearward end thereof and positioned for engagement with the sides of the highback to define the forward lean angle and substantially reduce the aft flexure of the ankle support portion of the boot when the boot is coupled to the snowboard.

14. The step-in binding of claim 7, further comprising an L-shaped attachment arm having an upper end and a lower end, the attachment arm is hingedly attached to the highback such that the lower end of the attachment arm may lockingly engage a notch centrally located on the lower side of the heel loop when the boot is secured to the first binding member to secure the heel end of the boot to the snowboard.

15. The step-in binding of claim 7, further comprising a substantially U-shaped buckle depending downwardly from the highback.

16. The step-binding of claim 15, further comprising a rectangularly shaped receiver centrally located on the arcuate portion of the heel loop and sized to slidably receive the arms of the buckle therein when the boot is secured to the first binding member to define the forward lean angle and substantially reduce the aft flexure of the ankle support portion of the boat.

17. The step-in binding of claim 1, further comprising a bearing surface defined on one of a lower end of the ankle support member or the lean support member, and disposed to bear against the other of the ankle support member or the lean support member when the boot is coupled to the first binding member, thereby preventing aft flexure beyond the minimum forward lean angle.

18. The step-in binding of claim 17, wherein the bearing surface is defined by a stopper block secured to a lower end of the highback.

19. The step-in binding of claim 17, wherein the bearing surface is defined by a stopper block secured to the lean support member.

20. The step-in binding of claim 17, wherein the bearing surface is defined by a stopper member adjustably secured to one of the highback or the lean support member to enable adjustment of the minimum forward lean angle.

21. A step-in binding for securing a boot to a bearing member capable of traversing a surface, the boot having a sole defining a toe end, a heel end, and a binding attachment surface, an ankle support portion capable of flexing relative to the plane of the sole, and an elongate ankle support member mounted to the exterior of the boot in the calf area thereof, the step-in binding comprising:

(a) a rigid plate securable to the bearing member, the plate having a forward end and a rearward end;

(b) at least a first binding member attached to the plate for receiving and coupling to the binding attachment surface of the boot;

(c) a release member attached to the first binding member for selectively releasing the boot from the first binding member; and (d) elongate first and second lean support members having an upper surface, a forward end, and a rearward end, the first and second lean support members are fastened to opposing sides of the plate near the rearward end thereof, the first and second lean support members are positioned for engagement with the ankle support member to define a minimum forward lean angle of the boot and to limit the aft flexure of the ankle support portion of the boot.

22. The step-in binding of claim 21, wherein the ankle support member is a highback mounted to the exterior of the boot in the calf area thereof and extends from below to above the ankle area.

23. The step-in binding of claim 22, wherein the first and second lean support members further comprise first and second stopper blocks projecting upwardly from the upper surface and substantially near the rearward end thereof.

24. The step-in binding of claim 23, wherein the first and second stopper blocks are adapted to receive the highback when the boot is coupled to the bearing member to define the forward lean angle and substantially reduce the aft flexure of the ankle support portion of the boot.

25. The step-in binding of claim 22, wherein the first and second lean support members are slidably adjustable within the plate along the elongate direction thereof, such that the first and second lean support members may be adjusted to optimize the fit between the first and second lean support members and the boot.

26. A step-in binding for securing a boot to a snowboard, the boot having a sole defining a toe end and a heel end, the toe and heel ends having toe and heel binding attachment surfaces, respectively, the boot further having an ankle support portion capable of flexing relative to the plane of the sole and an elongate highback mounted to the exterior of the boot in the calf area thereof and extending from below to above the ankle area, the step-in binding comprising:

(a) a rigid plate securable to the snowboard, the plate having a forward end and a rearward end;

(b) a first binding member attached to the plate for receiving and coupling the toe attachment surface of the boot to the plate;

(c) a second binding member attached to the rearward end of the plate for receiving and coupling the heel attachment surface of the boot to the plate;

(d) a release member attached to the second binding member for selectively releasing the boot from the first binding member;

(e) an elongate stopper block fastened to the lower end of the highback of the boot, the stopper block having forward and rearward surfaces; and (f) a lean support member mounted to the rearward end of the plate for engagement with the stopper block to define a minimum forward lean angle of the boot and to limit the aft flexure of the ankle support portion of the boot when the boot is received within the first and second binding members and to permit the ankle support portion to flex beyond the minimum forward lean angle when the boot is not received within the first and second binding members.

27. The step-in binding of claim 26, wherein the lean support member is slidably adjustable within the plate between the forward and rearward ends thereof, such that the lean support member may be adjusted to optimize the fit between the lean support member and the boot.

28. The step-in binding of claim 26, wherein the stopper block comprises an adjustment member extending outwardly from the rearward surface to slidably adjust the stopper block along the elongate direction thereof, such that the degree of forward lean may be selectively optimized by the adjustment member.

29. A step-in binding for securing a boot to a bearing member capable of traversing a surface, the boot having a sole defining a toe end, a heel end, and a binding attachment surface, an ankle support portion capable of flexing relative to the plane of the sole, and an elongate ankle support member mounted to the exterior of the boot in the calf area thereof, the step-in binding comprising:

(a) at least a first binding member attached to the bearing member for receiving and coupling to the binding attachment surface of the boot, the first binding member having a forward end and a rearward end; and (b) a lean support member fastened to the rearward end of the first binding member for engagement with the ankle support member of the boot to define a minimum forward lean angle of the ankle support portion of the boot when the boot is received within the first binding member and to permit the ankle support portion of the boot to flex rearwardly beyond the minimum forward lean angle when the boot is not received within the first binding member.

30. A step-in binding for securing a boot to a bearing member capable of traversing a surface, the boot having a sole defining a toe end, a heel end, and a binding attachment surface, an ankle support portion capable of flexing relative to the plane of the sole, and an elongate ankle support member mounted to the exterior of the boot in the calf area thereof, the step-in binding comprising:

(a) at least a first binding member attached to the bearing member for receiving and coupling to the binding attachment surface of the boot, the first binding member having a forward end and a rearward end; and (b) a lean support member fastened near the rearward end of the first binding member for engagement with the ankle support member of the boot to define a minimum forward lean angle of the ankle support portion of the boot and to limit the aft flexure of the ankle support portion of the boot when the boot is received within the first binding member and to permit the ankle support portion of the boot to flex beyond the minimum forward lean angle when the boot is not received within the first binding member, wherein the bearing member is a snowboard, wherein the lean support member is slidably adjustable between the forward and rearward ends of the first binding member, such that the lean support member may be adjusted therein to optimize the fit between the lean support member and the heel end of the boot.

31. The step-in binding of claim 30, further comprising an elongate plate securable to the snowboard, the plate having a forward end and a rearward end, the first binding member is attached to the plate, the plate has upwardly projecting first and second flanges formed on opposing sides of the plate substantially near the rearward end thereof.

32. The step-in binding of claim 31, wherein the lean support member is a U-shaped heel loop having an upper side and a lower side, and the ends of the heel loop are fastened to the upwardly projecting first and second flanges.

33. A step-in binding for securing a boot to a snowboard, the boot having a sole defining a toe end and a heel end, the toe and heel ends having toe and heel binding attachment surfaces, respectively, the boot further having an ankle support portion capable of flexing relative to the plane of the sole and an elongate highback mounted to the exterior of the boot in the calf area thereof and extending from below to above the ankle area, the step-in binding comprising:

(a) a rigid plate securable to the snowboard, the plate having a forward end and a rearward end;

(b) a first binding member attached to the plate for receiving and coupling the toe attachment surface of the boot to the plate;

(c) a second binding member attached to the rearward end of the plate for receiving and coupling the heel attachment surface of the boot to the plate;

(d) a release member attached to the second binding member for selectively releasing the boot from the first binding member;

(e) an elongate stopper block fastened to the lower end of the highback of the boot, the stopper block having forward and rearward surfaces; and (f) a lean support member mounted near the rearward end of the plate for engagement with the stopper block to define a minimum forward lean angle of the boot and to limit the aft flexure of the ankle support portion of the boot when the boot is received within the first and second binding members and to permit the ankle support portion to flex beyond the minimum forward lean angle when the boot is not received within the first and second binding members, wherein the lean support member is slidably adjustable within the plate between the forward and rearward ends thereof, such that the lean support member may be adjusted to optimize the fit between the lean support member and the boot.

* * * * *